US012379115B2

(12) United States Patent
Brinkman

(10) Patent No.: US 12,379,115 B2
(45) Date of Patent: Aug. 5, 2025

(54) PORTABLE, SELF-CONTAINED COOLING DEVICE

(71) Applicant: Solo Brands, LLC, Grapevine, TX (US)

(72) Inventor: John P. Brinkman, Abilene, TX (US)

(73) Assignee: Solo Brands, LLC, Grapevine, TX (US)

( * ) Notice: Subject to any disclaimer, the term of this patent is extended or adjusted under 35 U.S.C. 154(b) by 0 days.

(21) Appl. No.: 18/453,921

(22) Filed: Aug. 22, 2023

(65) Prior Publication Data

US 2025/0043974 A1 Feb. 6, 2025

Related U.S. Application Data

(60) Provisional application No. 63/517,694, filed on Aug. 4, 2023.

(51) Int. Cl.

| | |
|---|---|
| ***F24F 6/14*** | (2006.01) |
| ***F24F 1/0029*** | (2019.01) |
| ***F24F 1/005*** | (2019.01) |
| ***F24F 1/0087*** | (2019.01) |
| ***F24F 6/00*** | (2006.01) |
| ***F24F 11/52*** | (2018.01) |

(52) U.S. Cl.

CPC ..... *F24F 6/14* (2013.01); *F24F 1/0029* (2013.01); *F24F 1/005* (2019.02); *F24F 1/0087* (2019.02); *F24F 11/52* (2018.01); *F24F 2006/008* (2013.01); *F24F 2006/146* (2013.01)

(58) Field of Classification Search

CPC ..... B01F 23/2132; F24F 2221/12; F24F 2006/146; F24F 6/14; F24F 6/12; F24F 5/0035; F04D 29/705; F04D 19/002

See application file for complete search history.

(56) References Cited

U.S. PATENT DOCUMENTS

| | | | | |
|---|---|---|---|---|
| 4,839,106 | A | 6/1989 | Steiner | |
| 5,667,732 | A * | 9/1997 | Lederer | B01F 23/21311 261/78.2 |
| 7,806,388 | B2 | 10/2010 | Junkel | |
| 7,997,565 | B1 | 8/2011 | Chan | |
| 9,263,775 | B1 * | 2/2016 | Lowchareonkul | H01M 10/488 |
| 9,339,827 | B2 | 5/2016 | Chan | |

(Continued)

FOREIGN PATENT DOCUMENTS

CN 101198990 A * 6/2008 ..... B65D 41/185

OTHER PUBLICATIONS

CN 101198990 A Translation (Year: 2008).*

(Continued)

*Primary Examiner* — Schyler S Sanks

(74) *Attorney, Agent, or Firm* — Haynes and Boone, LLP

(57) ABSTRACT

A portable, self-contained cooling device includes a base, a reservoir fixedly secured to the base and arranged to store a liquid usable for cooling. The device also includes a fan assembly fixedly secured to the reservoir at a location above the reservoir. The fan assembly includes a fan configured to generate an airflow, a motor configured to operate the fan, and a nozzle disposed to spray the liquid as a mist into the airflow. The device also includes a power source configured to power the fan, the power source being disposed at an elevation adjacent to or below the reservoir.

29 Claims, 13 Drawing Sheets

(56) References Cited

U.S. PATENT DOCUMENTS

| | | | | |
|---|---|---|---|---|
| 10,330,333 | B2 | 6/2019 | Kaleta | |
| 10,527,301 | B2 | 1/2020 | Schock | |
| 11,629,869 | B1 | 4/2023 | Barlettano | |
| 2006/0273195 | A1 | 12/2006 | Junkel | |
| 2012/0319308 | A1* | 12/2012 | Chen | F24F 5/0035 261/28 |
| 2015/0247644 | A1* | 9/2015 | Stearns | F24F 5/0035 261/37 |
| 2017/0045246 | A1* | 2/2017 | Kaleta | F24F 7/007 |
| 2021/0310718 | A1 | 10/2021 | Zeng | |

OTHER PUBLICATIONS

O2COOL, Elite Misting Fan, https://o2cool.com/products/elite-misting-fan?pr_prod_strat=use_description&pr_rec_id-c9e7a9bfa&pr_rec_pid+10007876469054&pr_ref_pid=10007876632894&pr_seq=uniform, 2 pages, retrieved Nov. 28, 2023.

O2COOL, Deluxe Misting Fan, https://o2cool.com/products/deluxe-misting-fan, 1 page, retrieved Dec. 15, 2023.

Ryobi, 18V One+ Bucket Top Misting Fan Kit, https:/www.ryobitools.com/products/details/33287187966, 13 pages, retrieved Nov. 28, 2023.

* cited by examiner

PORTABLE, SELF-CONTAINED COOLING DEVICE

CROSS-REFERENCE TO RELATED APPLICATION

This application claims the benefit of the filing date of and priority to U.S. Provisional Patent Application 63/517,694, filed Aug. 4, 2023, the entire disclosure of which is hereby incorporated herein by reference. This application also is related to U.S. Design application Ser. No. 29/909,419, filed Aug. 4, 2023, titled "Cooling Device," the entire disclosure of which is hereby incorporated herein by reference.

TECHNICAL FIELD

The subject matter described herein relates to a portable, self-contained device for cooling air. This self-contained electric evaporative cooler has particular but not exclusive utility for cooling outdoor areas.

BACKGROUND

An evaporative cooler (also known as a mister, swamp cooler, or evaporative air conditioner) is a device that evaporates water to provide local air cooling. Typical air conditioning systems using vapor-compression refrigeration cycles can have high power requirements, whereas evaporative cooling removes a relatively large amount of heat from the air in order to evaporate the water (e.g., as a result of water's large heat of vaporization). Dry air can be cooled significantly through water evaporation (e.g., the phase transition between liquid water and water vapor), with the only energy expenditure often being for the movement of water and air through the system. Evaporative cooling also adds moisture to the air, which can increase comfort in dry and moderate climates. The cooling potential for evaporative cooling is proportional to the relative humidity of the air (e.g., the difference between dry-bulb temperature and wet-bulb temperature).

Conventional portable evaporative coolers tend to be dependent on an external water supply such as a hose or bucket, an external power supply such as a wall outlet, and/or human power to operate a pumping or fanning mechanism. Portable evaporative coolers also suffer from poor performance and limited battery life as compared with larger, non-portable evaporative coolers. It is therefore to be appreciated that such conventional evaporative coolers have numerous drawbacks, including engineering tradeoffs between size and capability, and otherwise. Accordingly, long-felt needs exist for improved personal cooling systems that address the forgoing and other concerns.

The information included in this Background section of the specification, including any references cited herein and any description or discussion thereof, is included for technical reference purposes only and is not to be regarded as subject matter by which the scope of the disclosure is to be bound.

SUMMARY

Disclosed are examples of a self-contained electric evaporative cooler.

The self-contained electric evaporative coolers disclosed herein can be used to provide cooling and circulation of air in any environment. Some examples, among many others, include outdoor areas such as backyards, campsites, picnic sites, job sites, etc. Yet others may include indoor environments.

One general aspect includes a portable, self-contained cooling device which includes a base; a reservoir fixedly secured to the base, the reservoir being arranged to store a liquid usable for cooling; and a fan assembly fixedly secured to the reservoir at a location above the reservoir. The fan assembly may include: a fan configured to generate an airflow, a motor configured to operate the fan, and a nozzle disposed to spray the liquid as a mist into the airflow. The portable, self-contained cooling device also includes a power source configured to power the fan, the power source being disposed at an elevation adjacent to or below the reservoir.

Implementations may include one or more of the following features. The cooling device may include a battery compartment in the base. The battery compartment may be disposed below the reservoir. The reservoir may include a fill port for introducing the liquid into the reservoir the fill port being accessible with the fan assembly fixed to reservoir.

One general aspect includes a portable, self-contained cooling device that includes a reservoir arranged to store a liquid usable for cooling, and a fan assembly fixedly secured to the reservoir at a location above the reservoir. The fan assembly may include: a fan configured to generate an airflow, a motor configured to operate the fan, and a nozzle disposed to spray the liquid as a mist into the airflow. The portable, self-contained cooling device also includes a power source configured to power the fan, the power source being disposed at an elevation adjacent to or below the reservoir.

Implementations may include one or more of the following features. The reservoir may include a fill port for introducing the liquid into the reservoir the fill port being accessible with the fan assembly fixed to reservoir. The cooling device may include a base having a width wider than the reservoir, the base being disposed below the reservoir and being configured to provide stability to the cooling device. The cooling device may include a battery compartment in a base fixedly attached to the reservoir, where the battery compartment may be disposed below the reservoir.

One general aspect includes a portable, self-contained cooling device that includes a base; a reservoir fixedly secured at a location above the base, the reservoir being arranged to store a liquid usable for cooling; a top assembly fixedly secured at a location above the reservoir. The top assembly may include: a fan configured to generate an airflow, a motor configured to operate the fan, and a nozzle disposed to spray the liquid as a mist into the airflow. The portable, self-contained cooling device may also include a handle extending adjacent the reservoir from the base to the top assembly, the handle being shaped to be graspable by a user for one-handed carry.

Implementations may include one or more of the following features. The cooling device may include a battery compartment in the base. The battery compartment may be disposed below the reservoir. The reservoir may include a fill port for introducing the liquid into the reservoir the fill port being accessible with the fan assembly fixed to reservoir. The cooling device may include a top assembly, the top assembly including the fan assembly and a pivot joint defining a horizontal axis, the fan assembly being swivelable about the horizontal axis.

One general aspect includes a portable, self-contained cooling device that includes a sealed reservoir for storing a liquid; a base different from the reservoir and configured to support the reservoir; a pump configured to pump the liquid; a fan assembly that may include: a fan configured to intake air and expel air and a motor configured to operate the fan; and a nozzle configured to spray the liquid as a mist into the expelled air. The portable, self-contained cooling device also includes a power source configured to power the pump and the fan; a handle extending from at least one of the reservoir, the base, and the fan assembly and configured such that the portable, self-contained cooling device can be carried one-handed. The self-contained cooling device has a height and a width, the height being substantially greater than the width. The fan assembly is configured to swivel between 0 and 360 degrees around a horizontal axis defined by a left pivot arm and a right pivot arm.

Implementations may include one or more of the following features. The reservoir may be at least partly transparent. The nozzle may be located along a central axis of the fan. The powering of the pump by the power source may be controlled by a first switch. The powering of the motor by the power source may be controlled by a second switch. The reservoir may include a fill port. The fill port may be closable via a removable fill port plug. The fill port may be disposed behind a pivotable fill port cover. The nozzle may receive the liquid from the pump via a nozzle hose routed through the left pivot arm. The motor may be powered by the power source via a cable routed through the right pivot arm. The power source may include a power port configured to receive a power cable. The power source may include a rechargeable battery. The rechargeable battery may be configured to be removable. The self-contained device may include a status light-emitting diode (LED) whose illumination is indicative of a charge state of the rechargeable battery. The self-contained device may include a status liquid crystal display (LCD) displaying an image indicative of a charge state of the rechargeable battery. Implementations of the described techniques may include hardware, a method or process, or computer software on a computer-accessible medium.

One general aspect includes a self-contained evaporative cooler which includes a reservoir for storing a liquid; a pump configured to pump the liquid; and a fan assembly that includes: a nozzle configured to spray the liquid as a mist, a fan configured to intake air not containing the mist and expel air containing the mist, and a motor configured to operate the fan. The cooler also includes a power source configured to power the pump and the fan. The cooler also includes a handle configured such that the self-contained evaporative cooler can be carried one-handed. The cooler may have a height substantially greater than its width. The reservoir may be sealed such that the liquid will not spill from the reservoir if the self-contained evaporative cooler is tipped or inverted. The fan assembly may be configured to swivel between 0 and 360 degrees relative to the reservoir.

Implementations may include one or more of the following features. The swiveling may be around a horizontal axis. The horizontal axis may be defined by a left pivot arm and a right pivot arm. The nozzle may be located along a central axis of the fan.

One general aspect includes a self-contained portable air conditioner that includes a reservoir for storing a liquid; a pump configured to pump the liquid; a fan assembly that includes: a nozzle configured to spray the liquid as a mist; a fan configured to intake air and expel air containing the mist; and a motor configured to operate the fan, where the nozzle is located along a central axis of the fan. The self-contained portable air conditioner also includes a power source configured to power the pump and the fan. The self-contained portable air conditioner also includes a handle. The reservoir is sealed such that the liquid will not spill from the reservoir if the self-contained portable air conditioner is tipped or inverted. The fan assembly is configured to swivel between 0 and 360 degrees around a horizontal axis defined by a left pivot arm and a right pivot arm.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the self-contained electric evaporative cooler, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
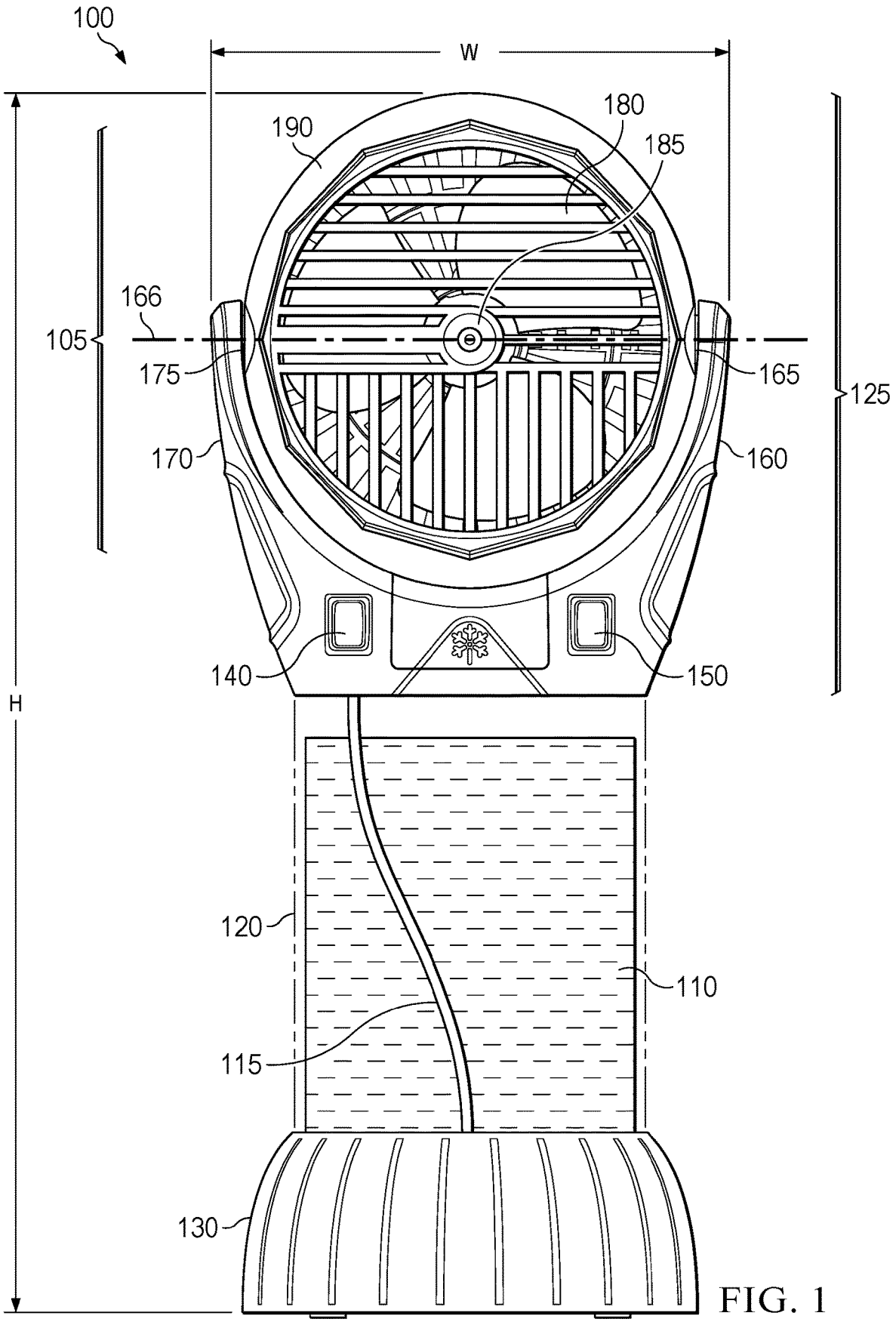
FIG. 1 is front view of an example self-contained electric evaporative cooler, in accordance with at least one embodiment of the present disclosure.

In accordance with at least one embodiment of the present disclosure, a self-contained, hand-portable electric evaporative cooler is described herein.

The self-contained electric evaporative cooler is a portable, unit that can readily be carried one-handed. It includes a reservoir configured to hold an amount of liquid water (e.g., a 2-liter reservoir, a 1-gallon reservoir, etc.). The cooler also includes a top assembly that is fixedly attached and sealed to the reservoir, as well as a base that supports the cooler in an upright position. In some examples, the base includes a removable, rechargeable battery. A handle may span between the base and the top assembly. The handle is configured for one-handed carrying of the cooler and, in some examples, includes a direct current (DC) power port and a charge status indicator, such as an LED. Some examples may include a top assembly includes a fill port, a fill port plug and fill port cover door, a pump, a pump power switch, a fan motor power switch, and a pivotable fan assembly capable of pivoting 360 degrees around a horizontal axis and thus capable of facing forward, rearward, upward, or downward.

The fan assembly may include a nozzle assembly, a fan, a fan motor, a front diffuser, and a rear diffuser. In some examples, the fan motor is capable of rotating the fan at 5220-6380 rotations per minute (RPM) and of moving an air volume of 5.9-7.2 cubic meters per minute, although higher and lower volumes are contemplated. The nozzle assembly is configured to spray a mist of water pumped by the pump from the reservoir. In some examples, the pump is configured to pump liquids at rate within a range of 0.005 to 0.06 liters per minute to the nozzle assembly. In some examples, the pump may pump approximately 0.02 liters per minute to the nozzle assembly, although other volumes are contemplated. It is noted that small droplets have a larger surface-area-to-volume ratio than large droplets, and thus evaporate more quickly. Thus, in order to promote evaporation (and thus evaporative cooling), the nozzle assembly may have an orifice diameter of 0.05 to 0.5 mm and preferably 0.1 to 0.3 mm, and is configured to produce droplets in a size range of 20 to 2000 microns and preferably between 20 and 300 microns, although other droplet sizes, both larger and smaller, may also be produced. Furthermore, in order to encourage uniform evaporation of the droplets, the nozzle is located in the center of the front diffuser and thus in the middle of the air stream generated by the fan. In some examples, the self-contained electric evaporative cooler has an operating temperature range of −10 to +70° C., and generates a nominal acoustic noise level of 65.02 dBA at a background noise level of 16.8 dBA, though it could be varied.

Some cooler examples utilize a battery. An example battery may comprise a 12-volt removable battery (e.g., a lithium-ion battery). In some examples, such a battery has a capacity of 6 Amp hours and is capable, when fully charged, of running the pump and fan for approximately 9 hours. Of course, other battery sizes are contemplated. In some examples described herein, the battery can be charged by the DC power port, or can be removed from the cooler, charged by an external charger, and then returned to the cooler. If desired, a user can therefore obtain spare battery packs that may be switched.

In some examples herein, the reservoir can be filled and/or emptied via the fill port, by opening a fill port door and removing a fill port plug. In some examples, the reservoir can also be emptied by the pump, but is otherwise sealed. In the examples herein, the reservoir is non-removable from the self-contained electric evaporative cooler (e.g., it is both glued and screwed in place). Thus, the reservoir is largely spillproof. In some embodiments, the reservoir is electrically water-proofed or sealed, and can be filled by immersing the entire cooler. In other embodiments, immersion of the entire cooler is not recommended. In some examples, the cooler reservoir may have a capacity within a range of 1-liter and four liters, although other volumes are contemplated. In some examples, the cooler has a reservoir capacity within about 1.5 to 2.5, liters, and yet in others, it may have a nominal capacity of 2.0 liters. In some examples where the capacity is around 2.0 liters, the reservoir can be emptied by the pump in 1.0-1.25 hours, though certainly other time periods are contemplated. Thus, the capacity of the reservoir and the fluid flow rate are the limiting factors on how long the self-contained electric evaporative cooler can operate without human attention.

In examples herein, the nozzle assembly is fed by a hose extending from a pivot arm of the top assembly and connecting to the pump inside the top assembly. The fan motor may be powered by an electrical cable extending from the left pivot arm of the top assembly. This separation of wiring and plumbing may both minimize the chance of an electrical short and minimize the amount of material required for both functions by providing the shortest possible route for both the electrical cable and the hose.

In examples described herein, the self-contained electric evaporative cooler is substantially taller than it is wide, thus providing a slim profile that is easy to pack, store, transport, and carry, and that can for example be stood up in a corner to provide cooling for a room, tent, vehicle interior, etc.

In some examples, the cooler can provide approximately 2260-2430 kilojoules (kJ) or 2142-2303 British Thermal Units (BTUs) of cooling per liter of water evaporated, within a range of approximately 15 feet (4.5 meters) from the cooler. Though it may vary depending on conditions, in some examples, the self-contained electric evaporative cooler may reduce air temperature by up to 25 degrees Fahrenheit (14 degrees centigrade, e.g., the difference between dry bulb and wet bulb temperatures of the surrounding air). It is noted that even greater air cooling can be accomplished by utilizing cold or chilled fluids in the reservoir, creating a large difference or delta between the fluid temperature and atmosphere temperature. This may be achieved, for example, by filling the reservoir with cold water and/or putting ice (e.g., crushed or cubed ice) into the reservoir through the fill aperture.

In some examples, the systems described herein may aid in cooling of outdoor and indoor spaces, by providing a sealed, spill-proof, hand-portable, electrically operated evaporative cooler with the capacity to cool an area by up to 25° F. for 1.25 hours without the need to refill the reservoir and for 9 hours without the need to recharge the battery.

It is noted that all of the numerical values presented herein are exemplary rather than limiting, and that the cooler can be adjusted to be larger, smaller, faster, or slower, etc. than described herein, and can produce larger or smaller droplets, while still falling within the scope of the present disclosure.

Examples described herein, including those utilizing an electric fan and electric pump operated by a rechargeable battery, may provide practical improvements in portable cooling technology. This improved cooling capability may replace both non-portable coolers and unsealed coolers with external power and water supplies, without the normally routine need to set up a complex apparatus. This unconventional approach improves the functioning of the cooling system, by maximizing the usefulness of its individual features.

The self-contained electric evaporative cooler may be operated by pump and fan switches. In that regard, the cooler may perform certain specific operations in response to different inputs or selections made at different times. Certain structures, functions, and operations of the pump, fan, and reservoir known in the art, while others are recited herein to enable novel features or aspects of the present disclosure with particularity.

These descriptions are provided for exemplary purposes only, and should not be considered to limit the scope of the self-contained electric evaporative cooler. Certain features may be added, removed, or modified without departing from the spirit of the claimed subject matter.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

FIG. 1 is front view of an example self-contained electric evaporative cooler 100, in accordance with at least one embodiment of the present disclosure. The cooler holds a liquid 110 (e.g., water) in a tank or reservoir 120. In an example, the reservoir has a capacity of between 1.5 and 2.5 liters, although other values both larger and smaller may be used instead or in addition. In some embodiments, the reservoir 120 is transparent, so that users can readily see when the liquid 110 in the reservoir 120 is getting low and needs to be refilled. The reservoir 120 rests on a base or stand 130 that is wider than the reservoir 120 and thus supports the reservoir 120 in an upright position, such that the self-contained electric evaporative cooler 100 has a height H that is substantially larger than its width W. A siphon hose 115 connects the bottom of the reservoir 120 to a pump.

In the example of FIG. 1, on top of the tank 120, and fixedly attached to the tank 120, is a top assembly 125 which includes a pivotable fan assembly 105. The top assembly 125 includes a pump switch 140 for activating the pump such that water is drawn from the reservoir 120 and expelled as a mist of droplets by the nozzle 185. The top assembly 125 also includes a fan switch 150 for activating the fan motor such that air is drawn through the rear of the fan 180 and expelled in a forward direction. The top assembly 125 also includes a right pivot arm 160, right pivot pin or pivot joint 165, left pivot arm 170, and left pivot pin or pivot joint 175, such that the fan assembly 105 can pivot 360 degrees around a horizontal pivot axis 166, and can thus point forward, upward, backward, or downward. The fan assembly 105 includes the fan 180, nozzle 185, front diffuser 190, as well as a rear diffuser, motor, motor cable, and nozzle hose, which are shown and described below.

The reservoir 120 is fixedly attached to the base 130 and the top assembly 125, such that the reservoir 120 is sealed. In particular, the reservoir 120 can be filled or emptied through a fill port as described below, and can be emptied through the siphon hose 115 by the pump as described below. However, when the fill plug is in place (see FIG. 9), the liquid 110 in the reservoir 120 will not spill out of the reservoir 120 even if the self-contained electric evaporative cooler 100 is tipped over, inverted, etc.

In an example, the components described above may be made predominantly of injection-molded plastic, except where other materials are necessitated by their functions, such as wiring, motor windings, or fasteners.

The example coolers 100 described herein are self-contained, meaning that they are single-assemblies during a normal use configuration. In addition, some of the components are described as being fixed together, fixedly attached, or fixedly secured. This is intended to convey that the components are joined together during regular use configurations, such as filling and cooling configurations. That is, they are intended to be fixed during a normal use of the cooler 100. It does not encompass intentional disassembly during non-use configurations. Because the cooler 100 is self-contained, it contains all the components that promote regular operation in a single unit. Because it is self-contained, it also enables the power source to be disposed on an opposite side of the cooler than the motor assembly (e.g., the battery is in the base and the fan is in the head unit) with the water reservoir in-between. The main assemblies are not disassembled or separated in normal use, except the fill plug described herein, usable to plug or stop the fill port on the self-contained cooler.

Figure 2:
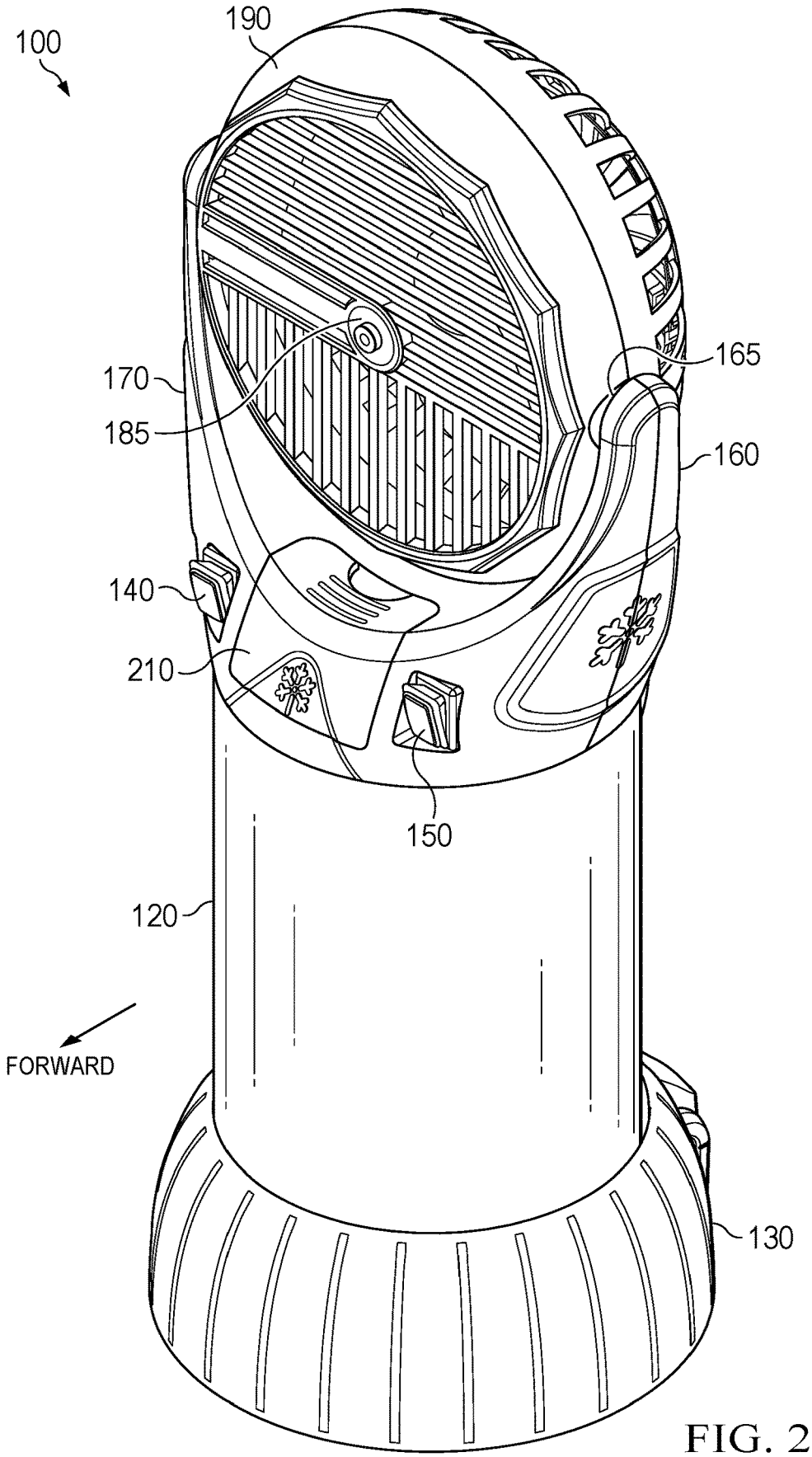
FIG. 2 is front right perspective view of an exemplary self-contained electric evaporative cooler in accordance with at least one embodiment of the present disclosure.

FIG. 2 is front right perspective view of an exemplary self-contained electric evaporative cooler 100 in accordance with at least one embodiment of the present disclosure. Visible are the front diffuser 190, nozzle 185, right pivot pin 165, right pivot arm 160, left pivot arm 170, pump switch 140, fan switch 150, reservoir 120, and base 130. Also visible is a fill port cover 210, which is configured to pivot in a forward/downward direction to expose the fill port and fill port plug, as shown for example in FIGS. 9 and 10, below.

Figure 3:
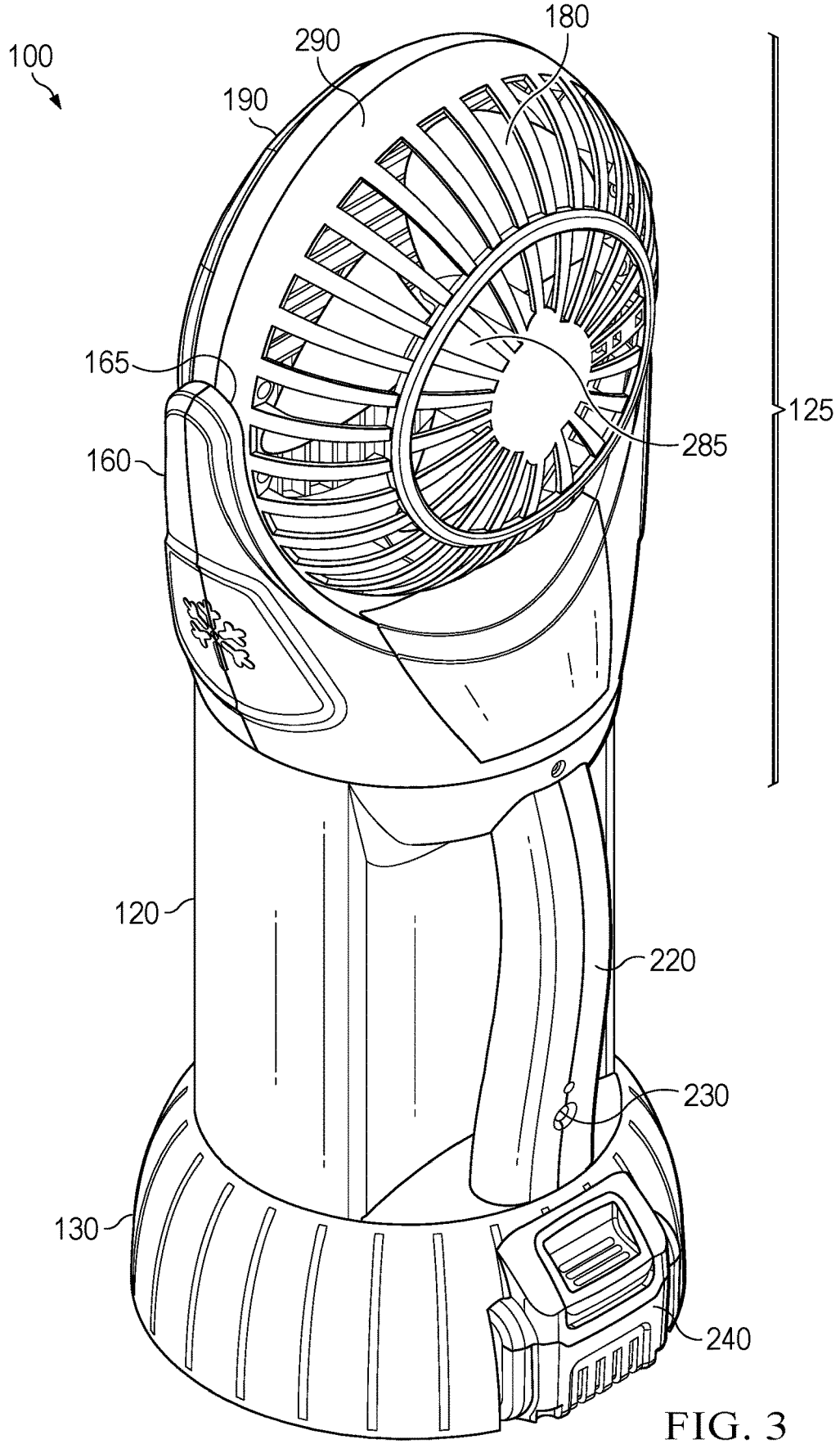
FIG. 3 is a left rear perspective view of an exemplary self-contained electric evaporative cooler in accordance with at least one embodiment of the present disclosure.

FIG. 3 is a left rear perspective view of an exemplary self-contained electric evaporative cooler 100 in accordance with at least one embodiment of the present disclosure. Visible are the front diffuser 190, fan 180, right pivot pin 165, right pivot arm 160, reservoir 120, and base 130. Also visible is the rear diffuser 290. When the fan 180 is operating, hot/dry air is drawn inward through the rear diffuser 290 and expelled through the front diffuser 190, while moisture is added to the air by the nozzle. Also visible is the fan motor 285, which drives the fan when the fan switch is in the on position.

A handle 220 spans between the base 130 and the top assembly 125. The handle is configured for one-handed carry by a person of ordinary strength. The handle includes a DC power port 230, which can be used to power the self-contained electric evaporative cooler 100 and/or to charge a removable, rechargeable battery 240 that clicks into the base 130. In some embodiments, the weight of the battery 240 helps lower the center of gravity of the self-contained electric evaporative cooler 100 such that is it less prone to tipping.

Figure 4:
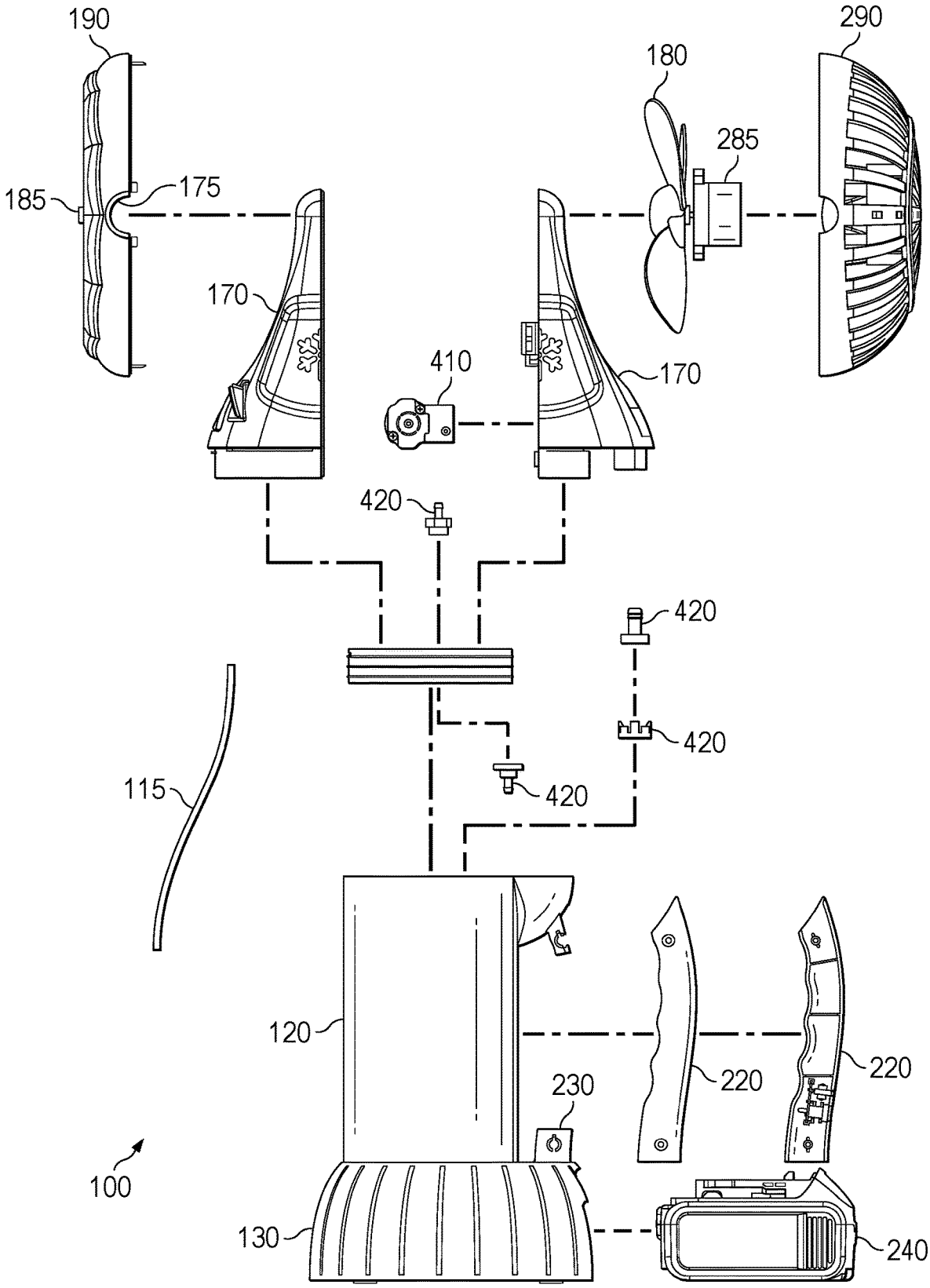
FIG. 4 is a left side exploded view of an exemplary self-contained electric evaporative cooler, in accordance with at least one embodiment of the present disclosure.

FIG. 4 is a left side exploded view of an exemplary self-contained electric evaporative cooler 100, in accordance with at least one embodiment of the present disclosure. Visible are the front diffuser 190, rear diffuser 290, fan 180, fan motor 285, nozzle 185, left pivot pin 175, left pivot arm 170, handle 220, siphon hose 115, tank 120, base 130, DC power port 230, and battery 240. Also visible is a pump 410 which pumps water from the reservoir 120 to the nozzle 185, via the siphon hose 115, when the pump switch is in the on position. Also visible are various seals and pressure fittings 420 as would be familiar to a person of ordinary skill in the art.

Figure 5:
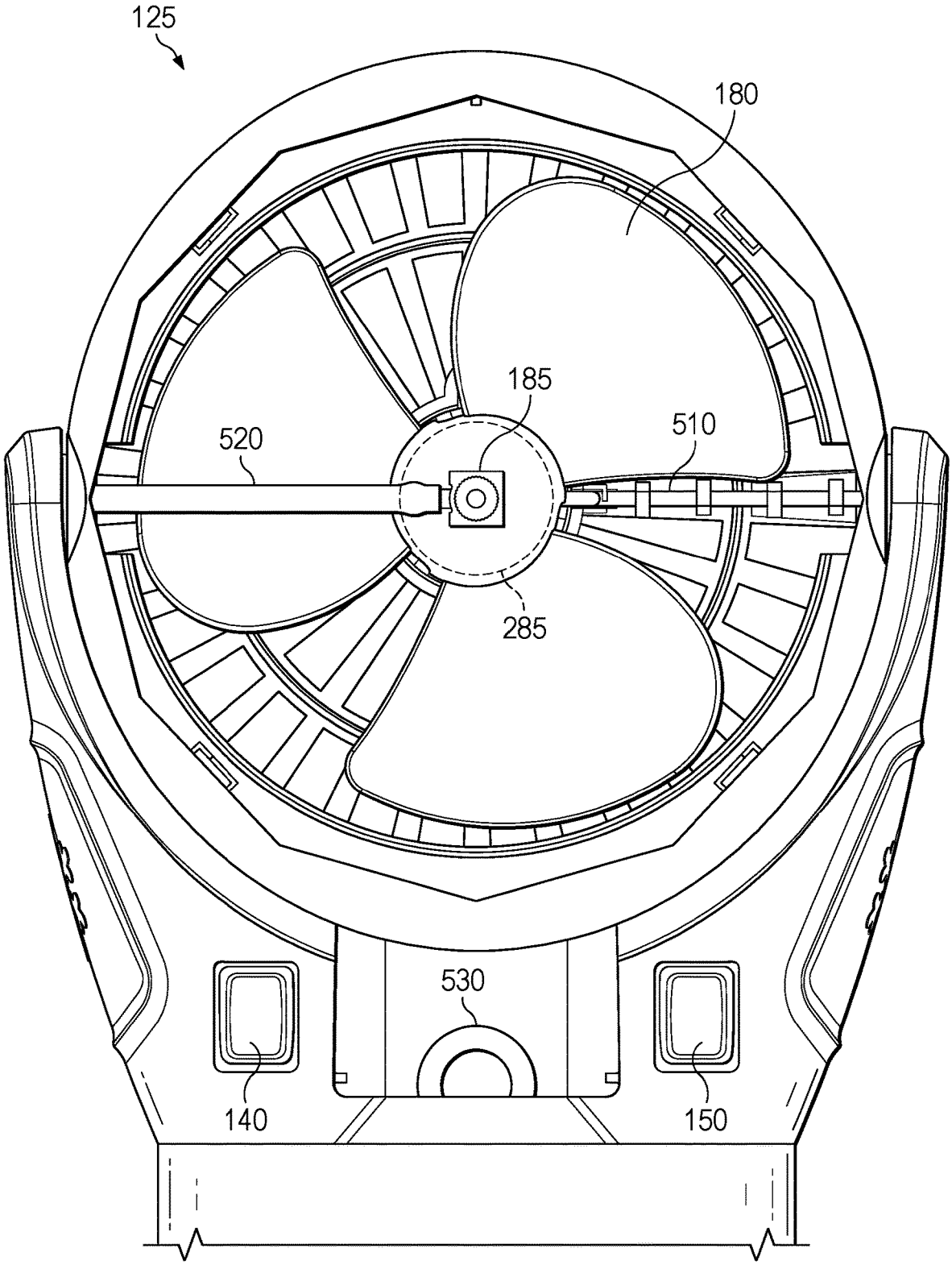
FIG. 5 is a front view of the top assembly of an exemplary self-contained electric evaporative cooler, in accordance with at least one embodiment of the present disclosure.

FIG. 5 is a front view of the top assembly 125 of an exemplary self-contained electric evaporative cooler 100, in accordance with at least one embodiment of the present disclosure. In the example shown in FIG. 5, the front diffuser and fill port cover have been removed for clarity. Visible are the fan motor 205, fan 180 nozzle 185, pump switch 140, and fan switch 150. A nozzle hose 520 connects the nozzle 185 to the pump (as shown for example in FIG. 12, below) for the transport of fluid to the nozzle 185. A fan motor cable 510 connects the fan motor 285 to the fan motor switch 150 (as shown for example in FIG. 12, below). A fill plug 530 is positioned within the fill port in order to seal off the reservoir 120. In an example, the fill plug is made from a soft, flexible, compressible material such as silicone, and includes retention features such as fins or ridges, such that it remains in place when the self-contained electric evaporative cooler 100 is tipped over or inverted, even if the reservoir is full. Similarly, the fill port can be filled or emptied while the top assembly (with its pivotable fan assembly) are fixedly attached to the tank.

Figure 6:
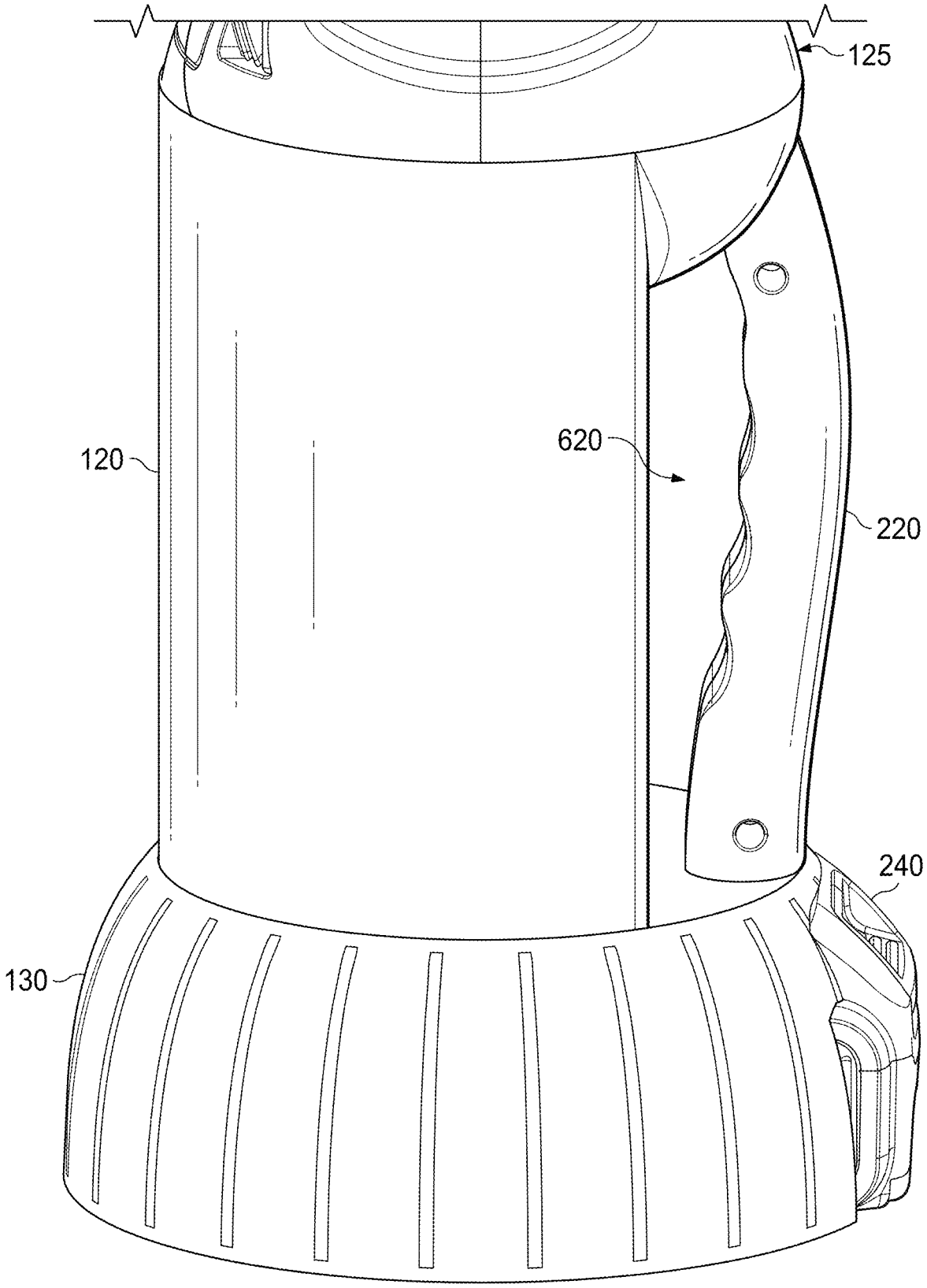
FIG. 6 is a left side view of the reservoir, base, and handle of an exemplary self-contained electric evaporative cooler, in accordance with at least one embodiment of the present disclosure.

FIG. 6 is a left side view of the reservoir 120, base 130, and handle 220 of an exemplary self-contained electric evaporative cooler 100, in accordance with at least one embodiment of the present disclosure. In between the handle 220 and reservoir 120 is a hand space 620 that is sized to accommodate the fingers of a large adult or small child, and thus to facilitate one-handed carrying of the self-contained electric evaporative cooler 100, whether full or empty. In some embodiments, depending on the implementation, the handle may connect to any or all of the base 130, the tank or reservoir 120, the top assembly 125, or the fan assembly. In some embodiments, the top assembly may be a fan assembly.

Figure 7:
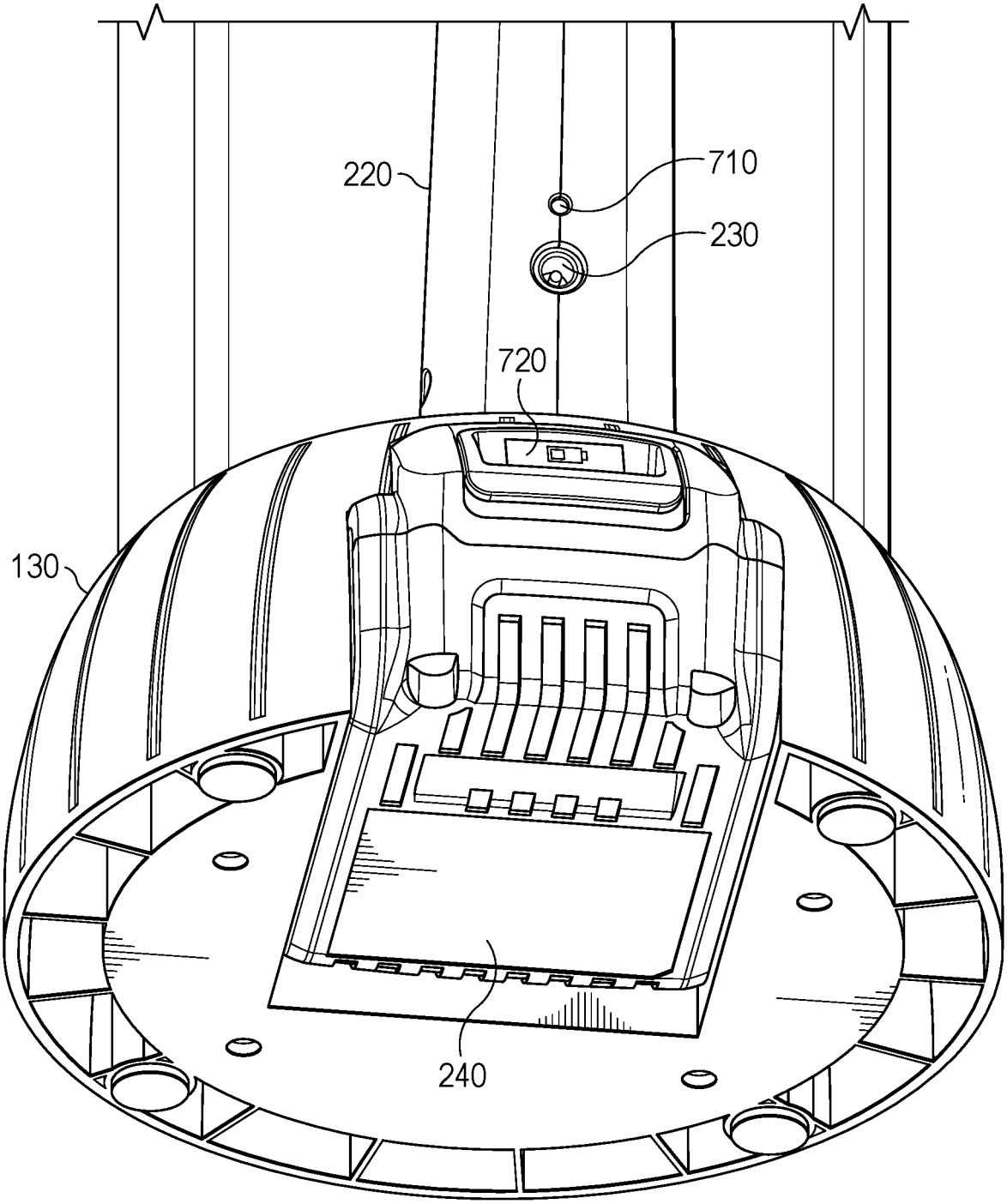
FIG. 7 is a bottom rear perspective view of the base and handle of an exemplary self-contained electric evaporative cooler, in accordance with at least one embodiment of the present disclosure.

FIG. 7 is a bottom rear perspective view of the base 130 and handle 220 of an exemplary self-contained electric evaporative cooler 100, in accordance with at least one embodiment of the present disclosure. Visible are the DC power port 230 and battery 240. In some embodiments, above the DC power port 230 is a status LED 710 that shows the charge state of the battery 240. In an example, the LED 710 is illuminated if the battery 240 is fully charged, and is otherwise not illuminated. In some embodiments, the battery 240 includes a liquid crystal display (LCD) battery charge indicator 720. In an example, the battery charge indicator, when pressed, displays a graphical representation of the charge remaining in the battery.

Figure 8:
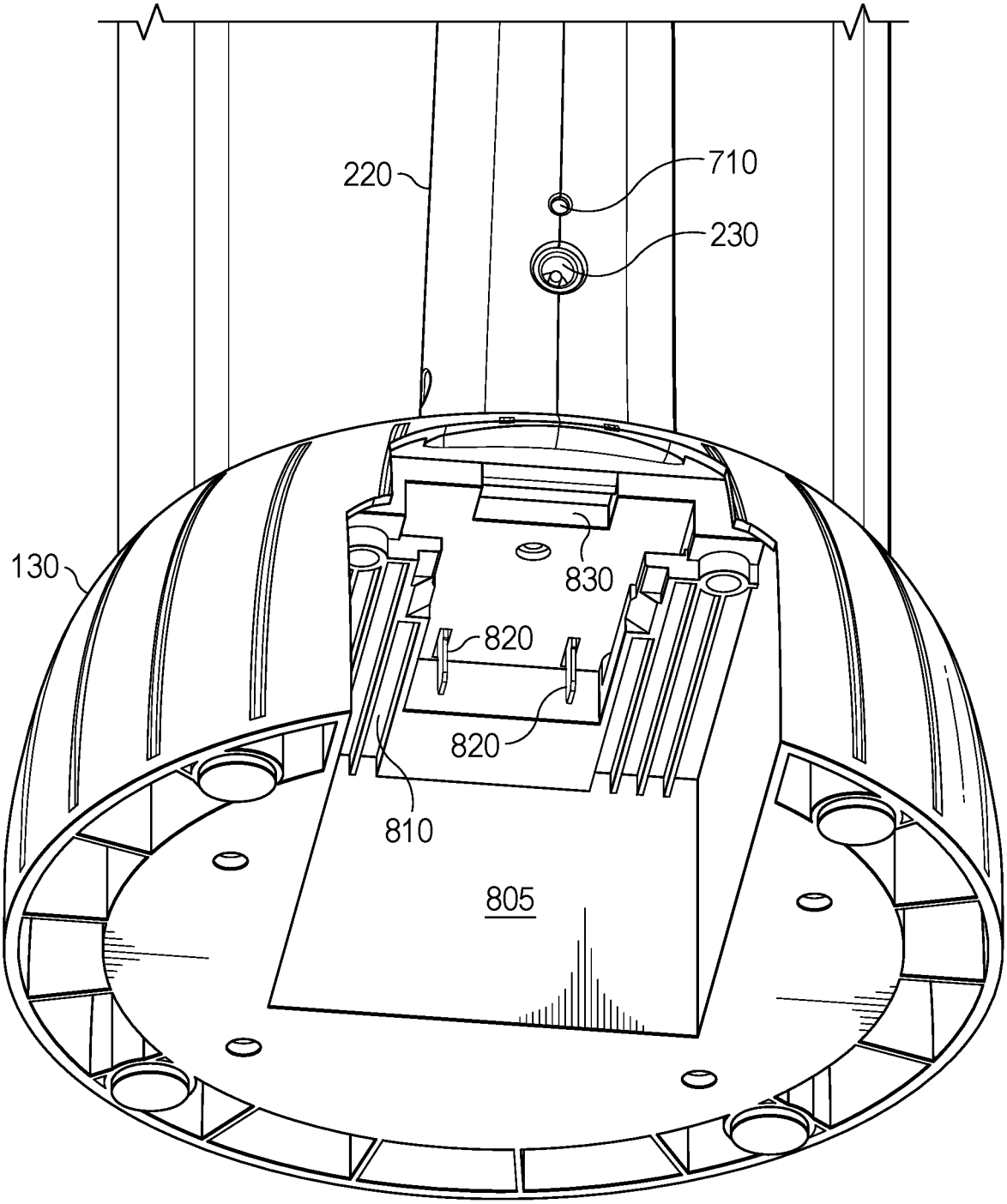
FIG. 8 is a bottom rear perspective view of the base and handle of an exemplary self-contained electric evaporative cooler, in accordance with at least one embodiment of the present disclosure.

FIG. 8 is a bottom rear perspective view of the base 130 and handle 220 of an exemplary self-contained electric evaporative cooler 100, in accordance with at least one embodiment of the present disclosure. In the example shown in FIG. 8, the battery has been removed from the battery compartment 805, revealing charging/discharging prongs 820, slide tracks 810, and a latch retention feature 830.

Figure 9:
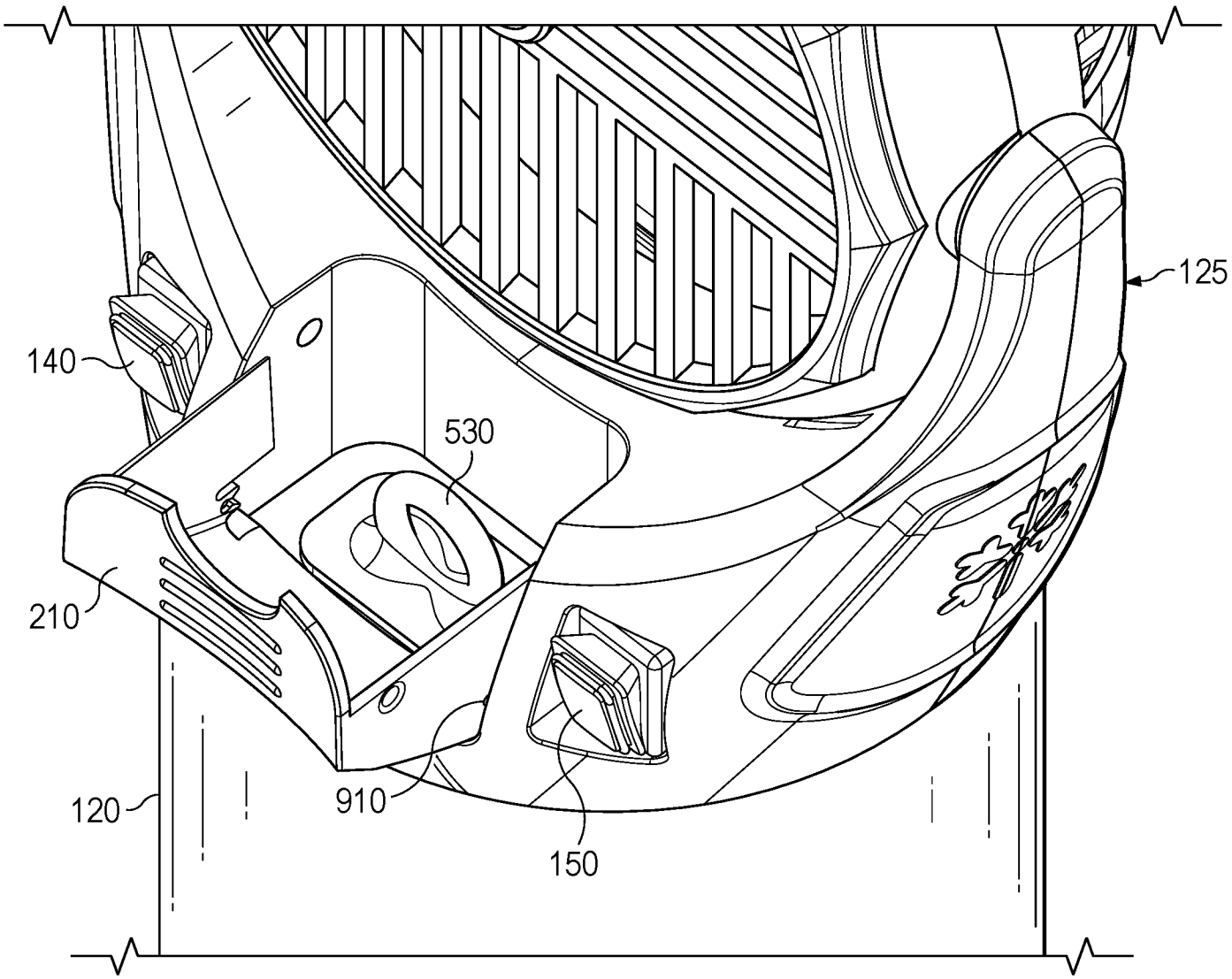
FIG. 9 is a front right perspective view of at the reservoir and top assembly of an exemplary self-contained electric evaporative cooler, in accordance with at least one embodiment of the present disclosure.

FIG. 9 is a front right perspective view of at the reservoir 120 and top assembly 125 of an exemplary self-contained electric evaporative cooler 100, in accordance with at least one embodiment of the present disclosure. Visible are the pump switch 140 and fan switch 150. In the example shown in FIG. 9, the fill port cover 210 has been opened by pivoting it forward and downward around hinge points 910, to expose the fill port plug 530.

Figure 10:
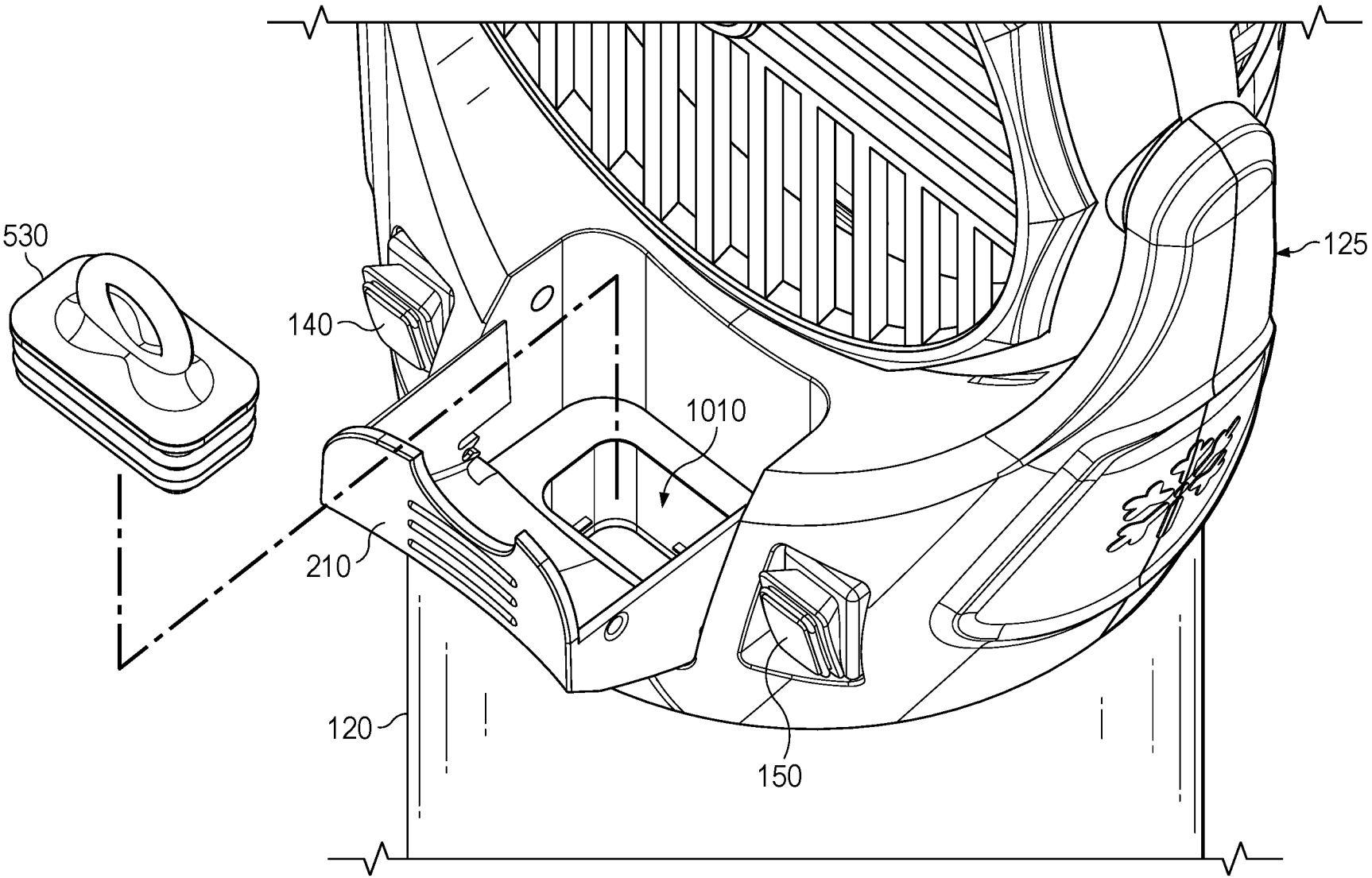
FIG. 10 is a front right perspective view of at the reservoir and top assembly of an exemplary self-contained electric evaporative cooler, in accordance with at least one embodiment of the present disclosure.

FIG. 10 is a front right perspective view of at the reservoir 120 and top assembly 125 of an exemplary self-contained electric evaporative cooler 100, in accordance with at least one embodiment of the present disclosure. Visible are the pump switch 140 and fan switch 150. In the example shown in FIG. 9, the fill port cover 210 has been opened and the fill port plug 530 has been removed, to expose the fill port 1010. The reservoir 120 is filled by pouring water into the fill port, e.g., from a faucet, hose, bucket, funnel, etc. The fill port plug 530 is then pressed back into the fill port 1010, and the fill port cover 210 is closed by pivoting it in an upward and rearward direction.

Figure 11:
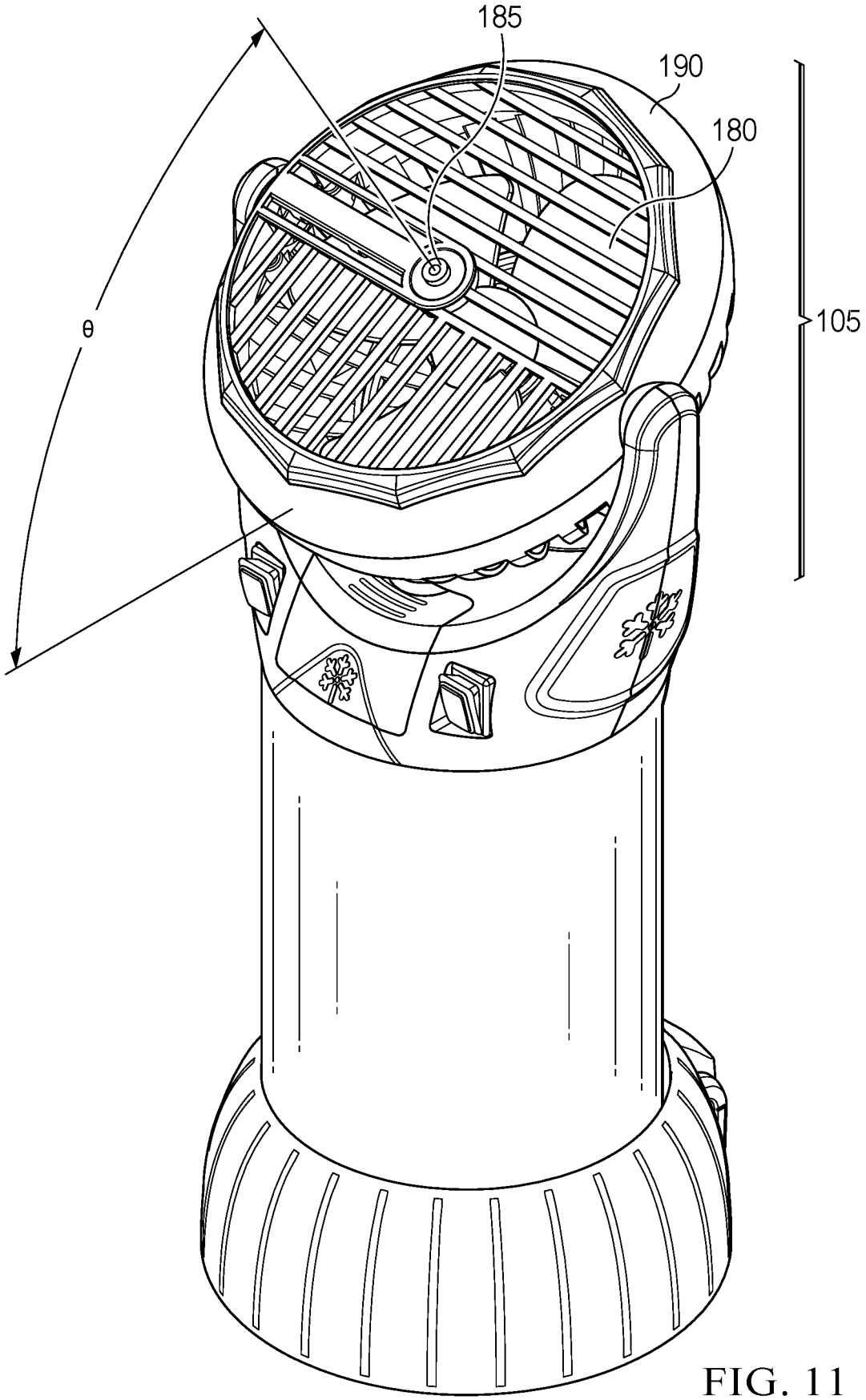
FIG. 11 is a front right perspective view of an exemplary self-contained electric evaporative cooler, in accordance with at least one embodiment of the present disclosure.

FIG. 11 is a front right perspective view of an exemplary self-contained electric evaporative cooler 100, in accordance with at least one embodiment of the present disclosure. In the example shown in FIG. 11, the fan assembly 105 has been pivoted upward by an angle of 0 degrees. Because the nozzle hose 520 and fan motor cable 510 are routed separately through opposite sides of the pivot axis 166 (see FIGS. 1 and 5), the fan assembly is able to pivot by a full 360 degrees around the pivot axis, thus pointing in a forward, upward, rearward, or downward direction, without tangling, crimping, crushing, or disconnecting either the nozzle hose 520 or the fan motor cable 510. Since the self-contained electric evaporative cooler 100 as a whole can also be placed in any orientation around a vertical axis (e.g., with its front facing north, south, east, or west), this 360-degree swivel capability means that the cool air stream emitted by the self-contained electric evaporative cooler 100 can be oriented in any desired direction in 3D space, while remaining upright on the ground or another surface.

Figure 12:
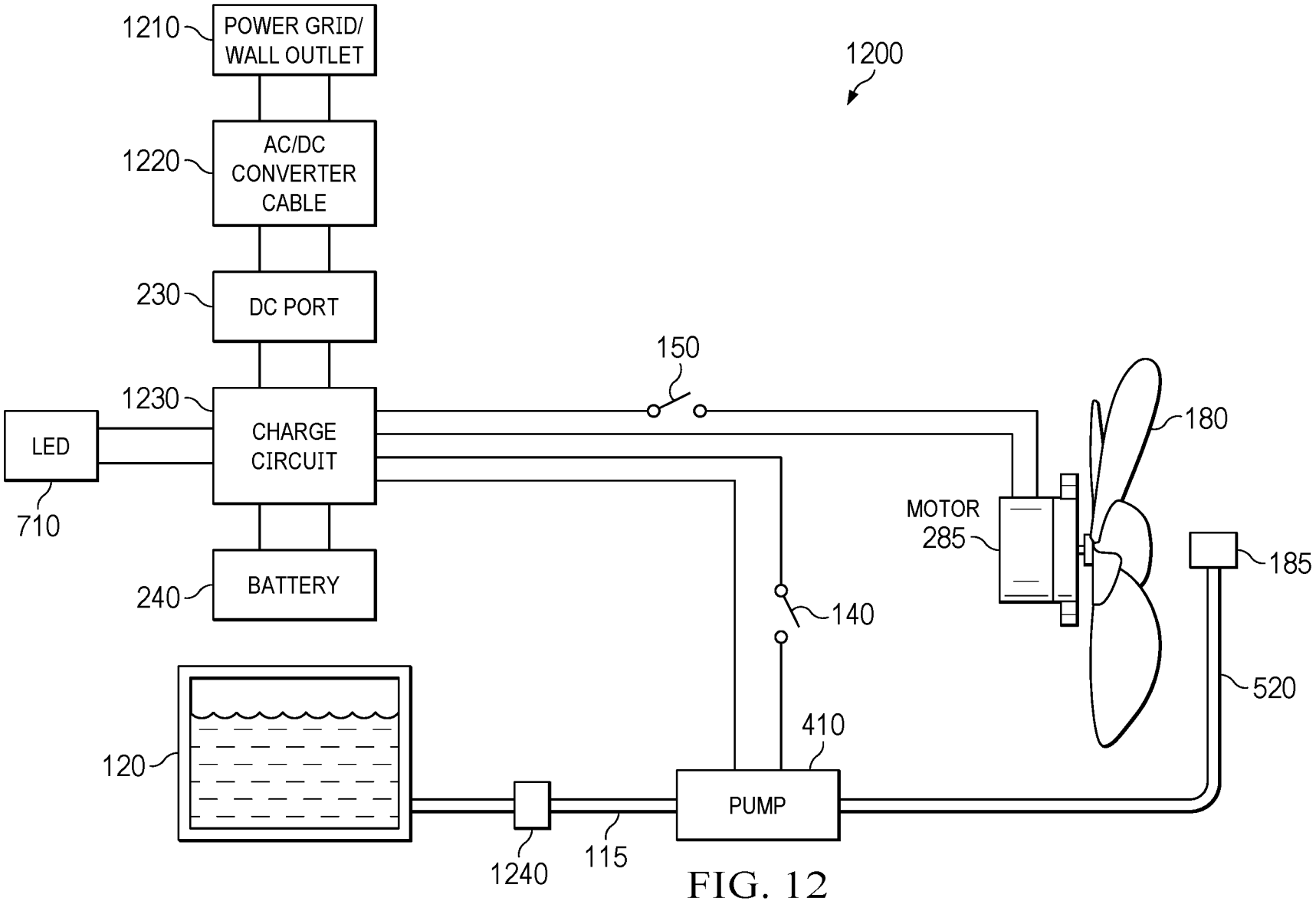
FIG. 12 is a schematic, diagrammatic representation, in block diagram form, of the plumbing and wiring of an exemplary self-contained electric evaporative cooler, in accordance with at least one embodiment of the present disclosure.

FIG. 12 is a schematic, diagrammatic representation 1200, in block diagram form, of the plumbing and wiring of an exemplary self-contained electric evaporative cooler 100, in accordance with at least one embodiment of the present disclosure. In the example shown in FIG. 1, electrical grid power from a wall outlet 1210 (e.g., 27-33 Watts of input power at a voltage of 8-14 Volts and a current of 2.25-2.75 Amperes) flows into an AC/DC converting power cable or charging cable 1220, which can be connected to the DC charging port 230. The DC charging port 230 passes current along to a charging circuit 1230, which performs several functions. First, the charging circuit 1230 monitors the charge state of the battery 240, and passes charging current to the battery 240 as needed. Second, the charging circuit 1230 controls the illumination of the status LED 710 (e.g., illuminating the status LED if the battery is fully charged). Third, under control of the fan switch 150, the charging circuit 1230 passes current to the fan motor 285 in order to rotate the fan 180. Fourth, under control of the pump switch 140, the charging circuit 1230 passes current to the pump, thus enabling it to pump fluid from the reservoir 120, through the siphon hose 115 and an optional filter 1240, through the nozzle hose 520, to the nozzle 185.

In an example, the switches are sealed and booted against the housing of the top assembly, and may be single contact switches (e.g., on/off), or multiple contact switches (e.g., low/medium/high), or variable switches, such as rotatable knobs that go between a low or zero setting and a high setting. Accordingly, the motor and/or pump may also be configured to operate at variable speeds.

It is noted that block diagrams are provided herein for exemplary purposes; a person of ordinary skill in the art will recognize myriad variations that nonetheless fall within the scope of the present disclosure. For example, block diagrams may show a particular arrangement of components, modules, services, steps, processes, or layers, resulting in a particular flow of data, power, fluid, etc., It is understood that some embodiments of the systems disclosed herein may include additional components, that some components shown may be absent from some embodiments, and that the arrangement of components may be different than shown, resulting in different flows while still performing the methods described herein.

Figure 13:
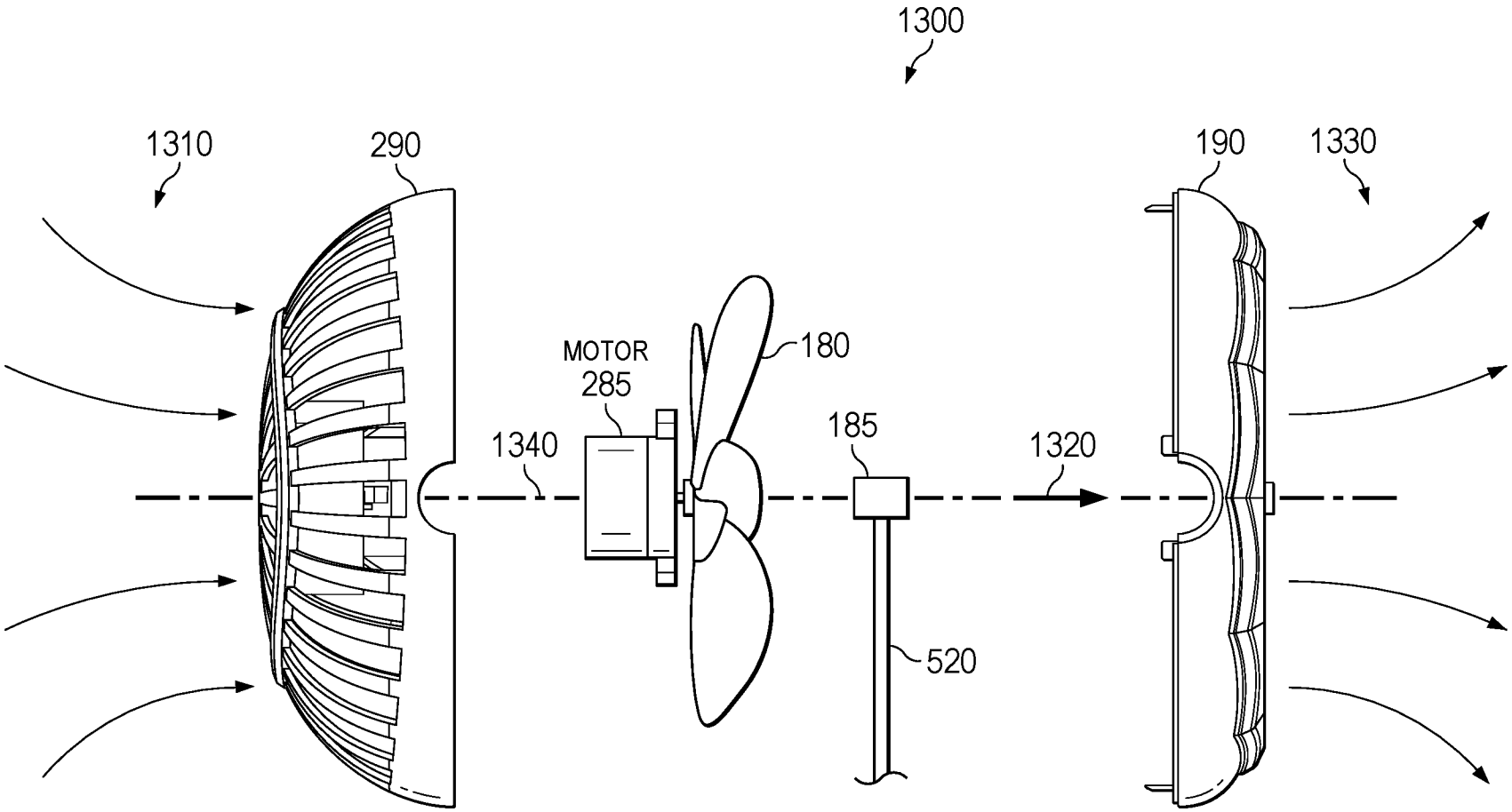
FIG. 13 is a schematic, diagrammatic representation of air flow through an exemplary self-contained electric evaporative cooler, in accordance with at least one embodiment of the present disclosure.

FIG. 13 is a schematic, diagrammatic representation 1300 of air flow through an exemplary self-contained electric evaporative cooler 100, in accordance with at least one embodiment of the present disclosure. When the fan motor 285 is on and the fan 180 is rotating, hot, dry air 1310 is drawn in through the rear diffuser 290, passed over the fan 180, and then expelled through the front diffuser 190. Such air movement can provide a cooling effect by itself, even in the absence of additional moisture. However, when the pump is also on, the nozzle 185 injects moisture 1320 in the form of fine water droplets into the airflow, such that humid air 1330 is expelled forward from the front diffuser 190. As the moisture 1320 evaporates (e.g., as the mist of fine droplets phase changes into individual molecules of water vapor), the temperature of the air is reduced as described above. Because the nozzle 185 is located along a central axis 1340 of the fan 180, the mixing of the moisture 1320 with the expelled air 1330 is maximized, leading to more uniform evaporation of the droplets.

In an example, the self-contained electric evaporative cooler functions with tap water as its working fluid. In some embodiments, the self-contained electric evaporative cooler may also be capable of using sea water, lake or river water, chlorinated water (e.g., from a swimming pool), distilled water, deionized water, etc. Depending on the implementation, other liquids than water may be used. However, since water is plentiful, environmentally friendly, and has a heat of vaporization (2260-2430 J/g) that is very high compared with other liquids, water is a preferred liquid to use.

As will be readily appreciated by those having ordinary skill in the art after becoming familiar with the teachings herein, the self-contained electric evaporative cooler provides a slim, hands-free, small-footprint, one-hand-portable, spillproof, cordless evaporative cooler whose fan assembly can rotate 360 degrees around a horizontal axis, while the cooler itself can be placed in any orientation around a vertical axis on virtually any desired surface, including tilted surfaces. Accordingly, it can be seen that the self-contained electric evaporative cooler fills a long-standing need in the art, by allowing a cooled, humidified air stream to be positioned and oriented virtually anywhere, whether indoors or outdoors. In some examples, the self-contained electric evaporative cooler can run for an hour or more without refilling, and for up to 9 hours without recharging the battery, thus providing a viable cooling solution for events such as parties, barbecues, presentations, etc. Furthermore, in examples where the water reservoir is transparent, users can easily see when the self-contained electric evaporative cooler need to be refilled, thus ensuring continuous operation.

A number of variations are possible on the examples and embodiments described above. For example, the self-contained electric evaporative cooler may be larger or smaller than shown herein, may have a larger or smaller reservoir or battery capacity, or may have a faster or slower fan or pump. Except for wiring, motor windings, and fasteners, the self-contained electric evaporative cooler may be made predominantly of plastic (e.g., injection-molded or 3D-printed plastic), or of other materials including glass, ceramic, metal, composites, or combinations thereof, without departing from the spirit of the present disclosure.

Accordingly, the logical operations making up the embodiments of the technology described herein are referred to variously as operations, steps, objects, elements, components, or modules. Furthermore, it should be understood that these may occur or be performed or arranged in any order, unless explicitly claimed otherwise or a specific order is inherently necessitated by the claim language.

Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A portable, self-contained cooling device, comprising:
- a base;
- an enclosed reservoir fixedly secured to the base, the reservoir being arranged to store a liquid usable for cooling;
- a fan assembly directly coupled to the reservoir and is indirectly coupled to the base only by the reservoir and a handle, the fan assembly comprising:
  - a fan having a central axis and configured to generate an airflow;
  - a motor configured to operate the fan; and
  - a nozzle disposed at the central axis of the fan and configured to spray the liquid into the airflow;
  - a front diffuser;
  - a rear diffuser;
  - a hose configured to direct the liquid toward the nozzle, proximate to the central axis, the hose being disposed between the front diffuser and the rear diffuser in both a front-rear axis and an up-down axis, wherein the hose is in fluid communication with the reservoir; and
- a power source configured to power the fan, the power source being disposed within the base at an elevation completely below a top of the reservoir, wherein a weight of the power source at the elevation is sufficient to lower a center of gravity of the portable, self-contained cooling device such that the portable, self-contained cooling device is less prone to tipping.

2. The cooling device of claim 1, comprising a battery compartment in the base.

3. The cooling device of claim 2, wherein the battery compartment is disposed below the reservoir.

4. The cooling device of claim 1, wherein the reservoir comprises a fill port for introducing the liquid into the reservoir the fill port being accessible with the fan assembly fixed to the reservoir.

5. A portable, self-contained cooling device, comprising:
- an enclosed reservoir arranged to store a liquid usable for cooling;
- a fan assembly fixedly secured to the reservoir at a location above the reservoir, comprising:

a fan having a central axis and configured to generate an airflow;

a motor configured to operate the fan; and a nozzle disposed at the central axis and configured to spray the liquid into the airflow;

a front diffuser;

a rear diffuser;

a hose configured to direct the liquid toward the nozzle, proximate to the central axis, the hose being disposed between the front diffuser and the rear diffuser in both a front-rear axis and an up-down axis, wherein the hose is in fluid communication with the reservoir;

a pump configured pressurize the liquid to spray from the nozzle; and a power source configured to power the fan and the pump, the power source being disposed at an elevation completely below the top of the reservoir, wherein a weight of the power source at the elevation is sufficient to lower a center of gravity of the portable, self-contained cooling device such that the portable, self-contained cooling device is less prone to tipping.

6. The cooling device of claim 5, wherein the reservoir comprises a fill port for introducing the liquid into the reservoir the fill port being accessible with the fan assembly fixed to the reservoir.

7. The cooling device of claim 5, comprising a base having a width wider than the reservoir, the base being disposed below the reservoir and being configured to provide stability to the cooling device.

8. The cooling device of claim 5, comprising a battery compartment in a base fixedly attached to the reservoir, wherein the battery compartment is disposed below the reservoir.

9. A portable, self-contained cooling device, comprising:

a base;

a reservoir fixedly secured at a location above the base, the reservoir being arranged to store a liquid usable for cooling;

a top assembly fixedly secured at a location above the reservoir, the top assembly comprising:

a fan having a central axis and configured to generate an airflow;

a motor configured to operate the fan; and a nozzle disposed at the central axis of the fan and configured to spray the liquid into the airflow;

a front diffuser;

a rear diffuser;

a hose configured to direct the liquid toward the nozzle, proximate to the central axis, the hose being disposed between the front diffuser and the rear diffuser in both a front-rear axis and an up-down axis, wherein the hose is in fluid communication with the reservoir; and a handle not in contact with the reservoir and extending adjacent the reservoir from the base to the top assembly, the handle defining a hand space between the reservoir and the handle, wherein the hand space is shaped to accommodate the fingers of a user for one-handed carry.

10. The cooling device of claim 9, comprising a battery compartment in the base.

11. The cooling device of claim 10, wherein the battery compartment is disposed below the reservoir, wherein a weight of a battery disposed within the battery compartment is sufficient to lower a center of gravity of the portable, self-contained cooling device such that the portable, self-contained cooling device is less prone to tipping.

12. The cooling device of claim 9, wherein the reservoir comprises a fill port for introducing the liquid into the reservoir the fill port being accessible with the fan assembly fixed to reservoir.

13. The cooling device of claim 9, wherein the top assembly includes a fan assembly comprising the fan and a pivot joint defining a horizontal axis, the fan assembly being swivelable about the horizontal axis.

14. A portable, self-contained cooling device for cooling air, the device comprising:

an enclosed reservoir arranged to hold a liquid;

a base configured to support the reservoir;

a pump configured to pump the liquid;

a fan assembly comprising:

a fan having a central axis and configured to intake air and expel air;

a motor configured to operate the fan; and a nozzle disposed at the central axis of the fan and configured to spray the liquid into the expelled air;

a front diffuser;

a rear diffuser;

a hose configured to direct the liquid toward the nozzle, proximate to the central axis, the hose being disposed between the front diffuser and the rear diffuser in both a front-rear axis and an up-down axis, wherein the hose is in fluid communication with the reservoir;

a power source configured to power the pump and the motor; and a handle extending from the base and the fan assembly and not the reservoir and configured such that the self-contained device can be carried one-handed, wherein the self-contained device has a height and a width, the height being substantially greater than the width, wherein the fan assembly is configured to swivel around a horizontal axis defined by a left pivot arm and a right pivot arm.

15. The self-contained device of claim 14, wherein the reservoir is at least partly transparent.

16. The self-contained device of claim 14, wherein the powering of the pump by the power source is controlled by a first switch.

17. The self-contained device of claim 14, wherein the powering of the motor by the power source is controlled by a second switch.

18. The self-contained device of claim 14, wherein the reservoir comprises a liquid fill port for adding the liquid to the reservoir.

19. The self-contained device of claim 18, wherein the liquid fill port is closable via a removable fill port plug.

20. The self-contained device of claim 19, wherein the fill port plug within the liquid fill port is disposed behind a pivotable fill port cover that is attached to the reservoir by a hinge point.

21. The self-contained device of claim 14, wherein the nozzle receives the liquid from the pump via the hose, wherein the hose is routed through the left pivot arm.

22. The self-contained device of claim 14, wherein the motor is powered by the power source via a cable routed through the right pivot arm.

23. The self-contained device of claim 14, wherein the power source comprises a power port configured to receive a power cable.

24. The self-contained device of claim 14, wherein the power source comprises a rechargeable battery.

25. The self-contained device of claim 24, wherein the rechargeable battery is configured to be removable.

26. The self-contained device of claim 24, further comprising a status light-emitting diode (LED) whose illumination is indicative of a charge state of the rechargeable battery.

27. The self-contained device of claim 24, further comprising a status liquid crystal display (LCD) displaying an image indicative of a charge state of the rechargeable battery.

28. The self-contained device of claim 27, wherein the status liquid crystal display is positioned on the rechargeable battery.

29. The self-contained device of claim 14, wherein the fan assembly is fixedly secured to the reservoir at a location above the reservoir.

* * * * *